United States Patent [19]

Lukaszewski

[11] 4,292,754

[45] Oct. 6, 1981

[54] BAT-LIKE, BUBBLE-BLOWING DEVICE

[76] Inventor: Charles Lukaszewski, 178 William St., Port Ewen, N.Y. 12466

[21] Appl. No.: 188,816

[22] Filed: Sep. 19, 1980

[51] Int. Cl.[3] ..... A63H 33/28

[52] U.S. Cl. ..... 46/6; 273/26 B

[58] Field of Search ..... 46/6, 7, 8; 273/26 B

[56] References Cited

U.S. PATENT DOCUMENTS

| | | | |
|---|---|---|---|
| 3,120,387 | 2/1964 | Weinstein | 273/26 B X |
| 3,389,492 | 6/1968 | Sullivan et al. | 46/7 |
| 3,561,154 | 2/1971 | Skinner | 46/6 |

*Primary Examiner*—Gene Mancene

*Assistant Examiner*—Mickey Yu

[57] ABSTRACT

Discloses a bat-like, bubble-blowing device of hollow-cylindrical construction for blowing bubbles and for use as a game apparatus inclusively for children's batting practice and physical coordination in eye and arm movements. The device has a body portion and striking surface whose open end is dipped into a bubble solution to form a residual film thereon. A child forms a bubble on such open end by blowing through a blowing orifice in the device's handle portion, shakes the device to release such formed bubble, and then breaks the bubble by swinging the device for contact of the striking surface with such released bubble.

3 Claims, 3 Drawing Figures

BAT-LIKE, BUBBLE-BLOWING DEVICE

BACKGROUND OF THE INVENTION

1. Technical Field

This invention relates to soap bubble devices and game apparati, and in particular to a bat-like, bubble-blowing device of hollow-cylindrical construction with one end open and the other handle or grip end closed except for a suitable blowing orifice, such that the open end can be suitably dipped into a bubble-forming solution to form a film over such open end and such that a child can blow through such blowing orifice to form thereby a bubble on such open end.

2. Background Art

The prior art, U.S. Pat. No. 3,376,037, discloses a bat and tethered ball combination; U.S. Pat. No. 3,389,492 discloses a toy; U.S. Pat. No. 3,399,485 discloses a combined water gun and bubble forming toy.

BRIEF SUMMARY OF THE INVENTION

The object of the invention is to provide a bat-like, bubble-blowing device of plastic or other suitable material and of hollow-cylindrical construction that has a handle or grip portion provided with a blowing orifice and a body portion constituting a striking surface. Children can use the device to blow bubbless by dipping the body portion's open end in a bubble solution to form a residual film thereon and blowing through the blowing orifice for bubble formation. After a bubble has been formed on such open end, the child shakes the device to release into the air such formed bubble, then swings at such bubble with the object of breaking same by appropriately having the striking surface contact such bubble.

BRIEF DESCRIPTION OF THE DRAWINGS

The aforementioned object and other objects of the invention should be discerned and appreciated by reference to the drawings, wherein like reference numerals refer to similar parts throughout the several views, in which.

DETAILED DESCRIPTION OF THE INVENTION

Figure 1:
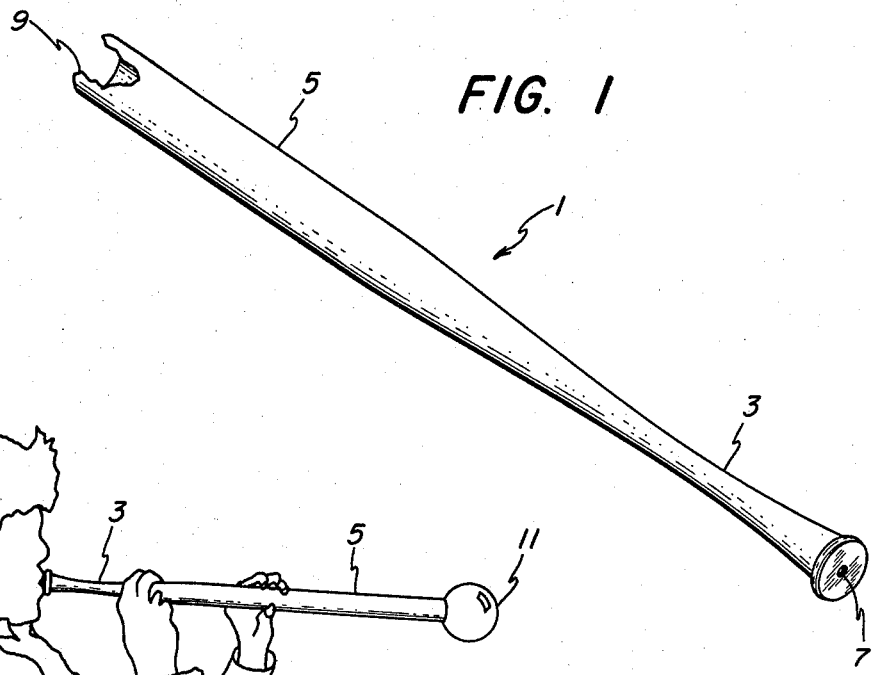
FIG. 1 is a perspective view of the invention.
Figure 2:
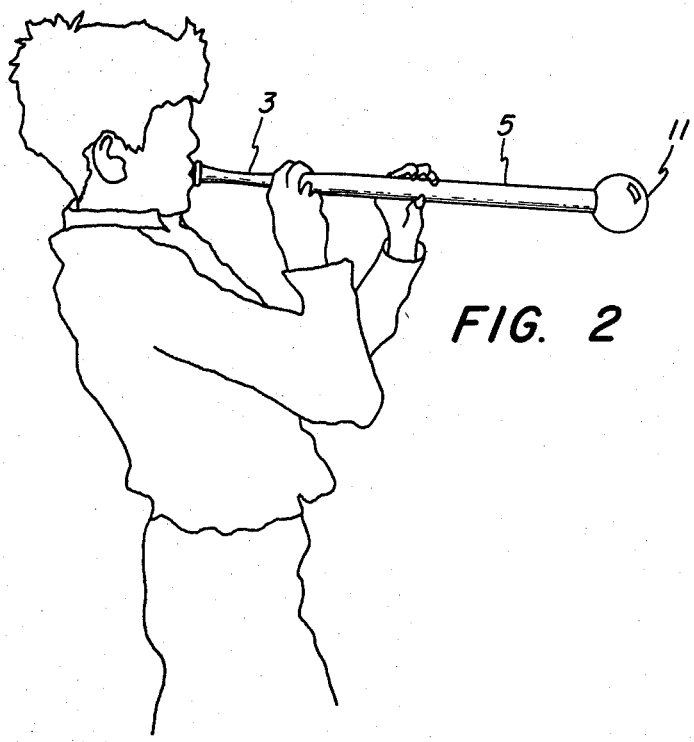
FIG. 2 is a view showing a child utilizing the invention to blow a bubble.
Figure 3:
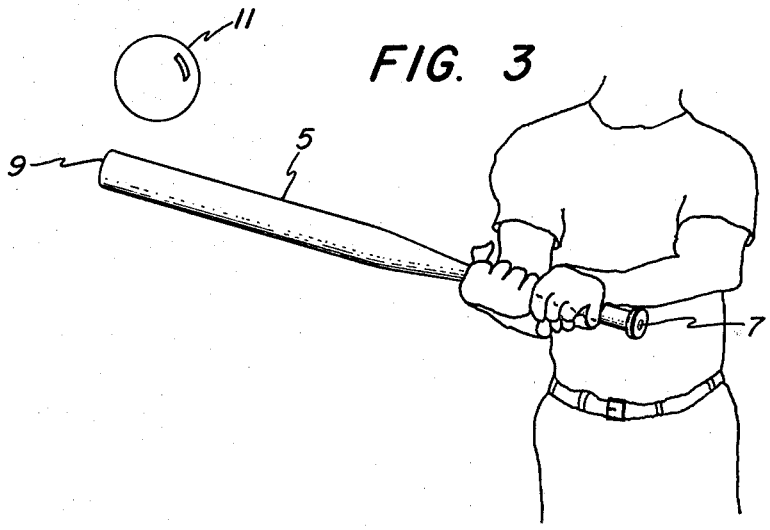
FIG. 3 is a view showing a child utilizing the invention to swing at a bubble formed and released from such invention.

In FIG. 1 of the drawings, reference numeral 1 generally refers to the invention comprising a bat-like, bubble-blowing device made of plastic or other suitable material. The bubble-blowing device 1 has the shape similar to a conventional baseball bat including a handle or grip portion 3 and a body portion 5 constituting the striking surface. The bubble-blowing device 1 is of hollow-cylindrical construction. The handle or grip portion 3 is closed except for a suitable blowing orifice 7. The striking surface 5 has an open end 9.

A child appropriately dips the open end 9 into a bubble solution of sufficient consistency such that upon removable of the open end 9 from such bubble solution a residual film of bubble solution will be formed over and cover open end 9. Next the child appropriately positions and places his mouth over the end of grip portion 3 such that his lips will be disposed around blowing orifice 7. The child then blows through blowing orifice 7 to form a bubble 11 of sufficient size, suitably shakes or otherwise moves the device 1 to release the formed bubble 11 from the open end 9, and then suitably grips handle portion 3 with his hands and swings at such bubble 11 with the object of striking, hitting and breaking bubble 11 for purposes of batting practice and physical coordination, or in attempting to score as many points by breaking such bubbles in accordance with whatever game rules the children or players devise in using the invention.

It should be appreciated that the greater the diameter of the resulting formed bubble 11, the greater will be its buoyancy and it will be lighter and tend to float in the air; and, hence, it will be easier to hit and break such bubble 11. By the same token, a bubble 11 formed having less diameter will be heavier and drop more quickly to the ground, and, hence the child will have to act more quickly in releasing such formed bubble 11 from the open end 9, in gripping the handle portion 3 and in swinging to have such striking surface 5 make contact with and break such bubble 11 before it falls to the ground.

Having thusly described my invention, I claim:

1. A bat-like, bubble-blowing device in combination with a bubble solution for use in blowing bubbles, said device having a size and shape similar to a conventional baseball bat including a handle portion and a body portion, said device being of hollow-cylindrical construction, said handle portion having a blowing orifice at its end and said body portion having an open end, a residual film over and covering said open end of said device being formed by dipping said open end in said bubble solution, and said blowing orifice being adaptable for a child to position and place his mouth over said handle portion such that his lips are disposed around said blowing orifice to thereby blow through said blowing orifice to form a bubble on said open end.

2. A bubble-blowing device in accordance with claim 1, wherein said device is of suitable plastic material.

3. A bubble-blowing device in accordance with claim 1, wherein same is adaptable for use as a game apparatus inclusively for children's batting practice and physical coordination by said body portion constituting a striking surface for swinging at and breaking bubbles formed on said open end and released therefrom.

* * * * *